US008176975B2

(12) United States Patent
Lake et al.

(10) Patent No.: US 8,176,975 B2
(45) Date of Patent: May 15, 2012

(54) TUBING PRESSURE INSENSITIVE ACTUATOR SYSTEM AND METHOD

(75) Inventors: Gary B. Lake, Houston, TX (US); David Z. Anderson, Glenpool, OK (US); Darren E. Bane, Broken Arrow, OK (US); Aaron T. Jackson, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 416 days.

(21) Appl. No.: 12/098,807

(22) Filed: Apr. 7, 2008

(65) Prior Publication Data

US 2009/0250206 A1 Oct. 8, 2009

(51) Int. Cl.
*E21B 23/00* (2006.01)
*E21B 47/00* (2012.01)

(52) U.S. Cl. ..... 166/66.7; 166/66.6; 166/250.01

(58) Field of Classification Search ..... 166/386, 166/373, 374, 66.6, 66.7, 319, 321, 332.1
See application file for complete search history.

(56) References Cited

U.S. PATENT DOCUMENTS

| | | | | |
|---|---|---|---|---|
| 2,770,308 | A * | 11/1956 | Saurenman | 166/66.6 |
| 4,687,054 | A | 8/1987 | Russell | |
| 5,252,043 | A | 10/1993 | Bolding | |
| 5,409,356 | A | 4/1995 | Massie | |
| 5,620,048 | A | 4/1997 | Beauquin | |
| 5,734,209 | A | 3/1998 | Hallidy | |
| 5,831,353 | A | 11/1998 | Bolding et al. | |
| 5,960,875 | A | 10/1999 | Beauquin et al. | |
| 6,109,351 | A | 8/2000 | Beall | |
| 6,173,785 | B1 * | 1/2001 | Adams et al. | 166/375 |
| 6,269,874 | B1 | 8/2001 | Rawson et al. | |
| 6,427,778 | B1 * | 8/2002 | Beall et al. | 166/321 |
| 6,619,388 | B2 | 9/2003 | Dietz et al. | |
| 6,926,504 | B2 | 8/2005 | Howard | |
| 7,111,675 | B2 | 9/2006 | Zisk, Jr. | |
| 7,145,271 | B2 | 12/2006 | Thirunarayan et al. | |
| 7,316,270 | B2 | 1/2008 | Shen | |
| 7,347,270 | B2 | 3/2008 | McMillan et al. | |
| 7,373,971 | B2 | 5/2008 | Montgomery | |
| 2003/0192687 | A1 * | 10/2003 | Goodson et al. | 166/65.1 |
| 2007/0289734 | A1 | 12/2007 | McDonald et al. | |
| 2007/0295515 | A1 | 12/2007 | Veneruso et al. | |
| 2008/0128137 | A1 | 6/2008 | Anderson et al. | |
| 2009/0229814 | A1 * | 9/2009 | Going, III | 166/66.4 |

OTHER PUBLICATIONS

U.S. Appl. No. 11/595,607. Darren E. Bane, et al.; "Tubing Pressure Insensitive Control System"; Filed with the United States Patent and Trademark Office Nov. 9, 2006. Specification having 10 pages. Drawings having 1 sheet.

(Continued)

*Primary Examiner* — Thomas Beach
*Assistant Examiner* — James Sayre
(74) *Attorney, Agent, or Firm* — Cantor Colburn LLP

(57) ABSTRACT

A tubing pressure insensitive actuator system includes a housing having a bore therein. A force transmitter is sealingly moveable within the bore, the force transmitter defining with the bore two fluid chambers. One of the fluid chambers is at each longitudinal end of the force transmitter. At least two seals are sealingly positioned between the housing and the force transmitter, with one of the seals isolating one end of the force transmitter from tubing pressure and another of the seals isolating another end of the force transmitter from tubing pressure. A method is also included.

21 Claims, 3 Drawing Sheets

OTHER PUBLICATIONS

Lynch, Christopher S.; "Development of a Piezoelectric Driven Hydraulic Pump/Actuator System for Use in Oil Well Tools"; The GWW School of Mechanical Engineering; The Georgia Institute of Technology; Atlanta, GA; Mar. 20, 2000; 18 pages.

Camco Products & Services; "The Development Specialist". 1997. 9 pages.

International Search Report and Written Opinion; PCT/2009/038210; Mailed Nov. 10, 2009; Written Opinion 4 Pages; International Search Report 3 Pages.

* cited by examiner

TUBING PRESSURE INSENSITIVE ACTUATOR SYSTEM AND METHOD

BACKGROUND

Surface Controlled Subsurface Safety Valves (SCSSV) are a common part of most wellbores in the hydrocarbon industry. Subsurface safety valves are generally located below the surface and allow production from a well while being closable at a moments notice should an imbalance in the operation of the well be detected either at the surface or at another location. In most constructions, SCSSVs are actively openable and passively closable ensuring that failures of the actuating system allow the valve to "fail safe" or in other words, fail in a closed position. Traditional subsurface safety valves have been hydraulically actuated. As operators move into deeper water, the use of hydraulics as the means of actuating subsurface safety valves becomes technically challenging as well as expensive. The technical limitations of hydraulics, the costs and reliability restrictions associated with hydraulics, and environmental issues are all work synergistically to increase costs of production, which necessarily results in lower profitability or increased pricing of the produced fluids. In view of these drawbacks, the art will well receive alternate SCSSV actuation systems that alleviate the same.

SUMMARY

A tubing pressure insensitive actuator system includes a housing having a bore therein; a force transmitter sealingly moveable within the bore the force transmitter defining with the bore two fluid chambers, one at each longitudinal end of the force transmitter; and at least two seals sealingly positioned between the housing and the force transmitter, one of the seals isolating one end of the force transmitter from tubing pressure and another of the seals isolating another end of the force transmitter from tubing pressure.

A tubing pressure insensitive actuator system for an electric surface controlled subsurface safety valve includes a subsurface safety valve housing supporting a flow tube, a flapper and a power spring, the housing having a force transmitter bore therein; a force transmitter sealingly moveable within the force transmitter bore, the force transmitter defining with the bore two fluid chambers, one at each longitudinal end of the force transmitter, at least one of the chambers containing an electric activator in operable communication with the force transmitter; an interengagement at the force transmitter force transmissively engaged with the flow tube, the interengagement exposed to tubing pressure during use; and at least two seals sealingly positioned between the housing and the force transmitter, one of the seals isolating one end of the force transmitter from tubing pressure and another of the seals isolating another end of the force transmitter from tubing pressure.

A method for reducing force requirements of an actuator in a downhole environment includes sealing a force transmitter within a housing to isolate ends of the force transmitter from tubing pressure during use; and initiating an activator to urge the force transmitter in a direction commensurate with activating a downhole tool, the actuator generating enough force to activate the downhole tool other than to overcome tubing pressure.

BRIEF DESCRIPTION OF THE DRAWINGS

Referring now to the drawings wherein like elements are numbered alike in the several Figures.

DETAILED DESCRIPTION

Among the challenges in developing an actuator system for, for example, an electric safety valve, or other tool intended to operate in an unfriendly environment such as a downhole environment, are isolation of an activator of the actuator from wellbore fluids during use and issues relating to force generation density. In order to avoid confusion in reading the instant disclosure, the term "actuator" is used to refer to the system level while the "activator" is used to refer to a prime mover level. With regard to the former, isolation of the activator mechanism from the environmental factors that are problematic for the activator, is desirable. Many wellbore fluids are contraindicated for contact with electrical activators due to their deleterious effects thereon. Moreover, with regard to the latter, force generation in an electric activator that rivals the force generating capacity of hydraulic activators, requires a significant increase in size of the activator relative to the hydraulic activators. Wellbore space is always at a premium so that it is desirable to maintain activator size as small as possible. To realize this goal, it is important to minimize the effect of tubing pressure on the tool being electrically actuated. This will minimize the forces that the electric actuator must overcome when actuating the tool. While clearly this will facilitate the use of actuators having less force generating capacity, rendering a force transmitter in a valve insensitive to tubing pressure is useful for any type of actuator including hydraulic actuators.

Figure 1:
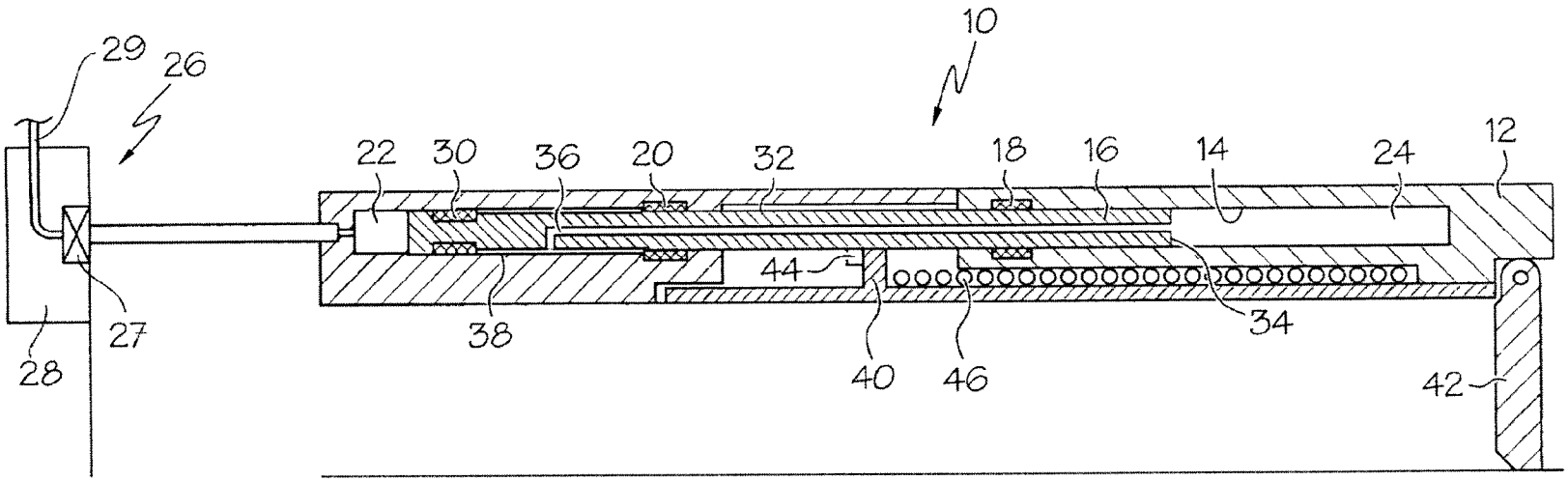
FIG. 1 is a schematic view of a tubing pressure insensitive electrically actuated SCSSV and actuation configuration.

Referring to FIG. 1 a first embodiment of a tubing pressure insensitive actuator system configured as an Electrically Actuated SCSSV ("ESCSSV") 10 is illustrated. The ESCSSV 10 includes a housing 12 having a bore 14 therein. A force transmitter 16, which may be a piston, ball nut, rod, etc. is slidingly and sealingly disposed within the bore 14. The housing 12 includes two sets of seals 18 and 20 that interact with the force transmitter 16 to provide a fluid tight seal therewith. The seals allow movement of the force transmitter in either longitudinal direction based upon applied differential fluid pressure across the force transmitter 16 and also prevent tubing pressure from acting on the force transmitter in a way that would create any differential pressure thereon. More specifically, because tubing pressure does not act on either end of the force transmitter, the force transmitter is insensitive to tubing pressure even though the force transmitter is exposed to tubing pressure along its length. This is desirable because the force required to actuate the valve through movement of the force transmitter is reduced due to not having to overcome tubing pressure. The force transmitter creates two relatively large fluid chambers 22 and 24 within the housing 12. One fluid chamber 22 contains hydraulic fluid that is pressurizable by a pressure source 26, while the other chamber 24 is filled with a compressible fluid such as air that may be at atmospheric pressure. In the FIG. 1 illustration, the pressure source 26 is a pump 27 and hydraulic fluid reservoir 28 to supply the pump 27. In one embodiment, the pump is an electric pump and thus will include a power cable 29 that may extend to a remote location such as a surface location or may extend only to an on-board power source (not shown). Pressure supplied by the source 26 to the chamber 22 will cause the force transmitter 16 to be displaced within the housing 12 toward the chamber 24. A force transmitter ring seal 30 ensures that hydraulic fluid from the source 26 does not escape around the force transmitter 16.

The force transmitter 16 itself defines a fluid conduit 32 therein that extends from one end 34 of the force transmitter 16 substantially axially to a dog leg 36 where the conduit 32 is directed to an annular space 38 defined between the force transmitter 16, the bore 14, the seal 20 and the force transmitter ring seal 30. This annular space 38 is sealed and thus will deadhead any fluid in the conduit 32. It is thereby invisible functionally with respect to an opening operation of the ESCSSV. The purpose of the conduit 32, dogleg 36 and annular space 38 is to ensure that the force transmitter is biased to a valve closed condition if one or more of the seal 20 fails. Alternately stated, the annular space 38 only becomes a functional part of the ESCSSV if and when the seal 20 is breached by tubing pressure applied thereto. This function will be further described hereunder.

The force transmitter 16 is further in operable communication with a flow tube 40 of the ESCSSV 10 such that the flow tube 40 is urged toward a flapper valve 42 to open the same upon activation of the ESCSSV 10. Any means for causing the flow tube 40 to move with the force transmitter is acceptable. In one embodiment, an interengagement 44 could simply be a tab on the force transmitter 16 as shown that is sufficiently strong to maintain structural integrity against a power spring 46 and any pressure differential across a flapper 42.

In this embodiment, chamber 24 is filled with a compressible fluid at a pressure easily overcomable by increased hydraulic pressure in chamber 22 or by an electric activator directly acting upon the force transmitter. In one embodiment, the pressure in chamber 24 is atmospheric pressure. The fluid may be air, for example, but in any event will be selected to have chemical properties not contraindicated for the type of activator utilized and in contact therewith.

Upon pressurization of chamber 22 by source 26, the force transmitter 16 moves farther into chamber 24 than is depicted in FIG. 1 and consequently urges the flow tube 40 against the flapper valve 42 causing the same to open. The ESCSSV will remain in this open condition while pressure on the chamber 22 is maintained. Upon loss of such pressure, the valve will close due to the action of a power spring 46 in a way familiar to the art.

In the event that seal 20 fails while the valve 10 is in the downhole environment, tubing pressure will enter annulus 38. The pressure in annulus 38 is transmitted through dogleg 36 and conduit 32 to chamber 24. Pressure in this chamber will cause the valve 10 to fail closed. Alternately, if seal 18 fails, pressure is directly transmitted to chamber 24 with the same result of biasing the valve 10 to a closed position. A failure of both seals 18 and 20 will also result in a biasing of the valve to a closed position.

Figure 2:
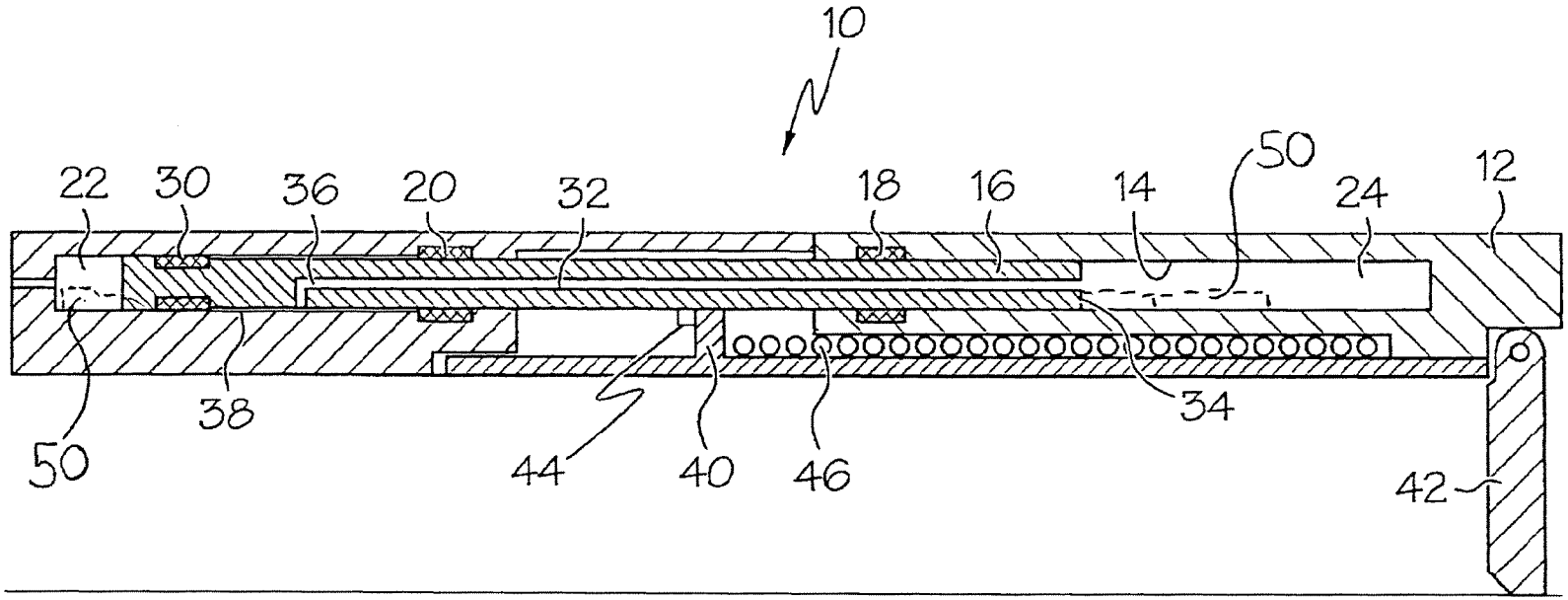
FIG. 2 is a schematic view of an alternate tubing pressure insensitive electrically actuated SCSSV and actuation configuration.

In another embodiment, referring to FIG. 2, pressure source 26 of FIG. 1 is eliminated in favor of an activator 50 that is housed within chamber 22 or chamber 24. The fluid in both chambers 22 and 24 must be of a nature that its volume is changeable without a significant change in pressure thereof. Compressible fluids such as air may be used as well as other fluids having the identified properties. The activator 50 may be an electromechanical device such as a lead screw, solenoid, etc. and will be configured as a push or a pull activator depending upon which chamber houses the activator 50. In the event that the activator 50 is housed in chamber 22 in the illustrated embodiment, it will be configured as a push activator and if the activator 50 is to be housed in the chamber 24, it will be configured as a pull activator. It is further to be appreciated that dual activators may also be used in this embodiment where one is a pull activator and one is a push activator. In other respects, FIG. 2 is similar to FIG. 1 herein.

Figure 3:
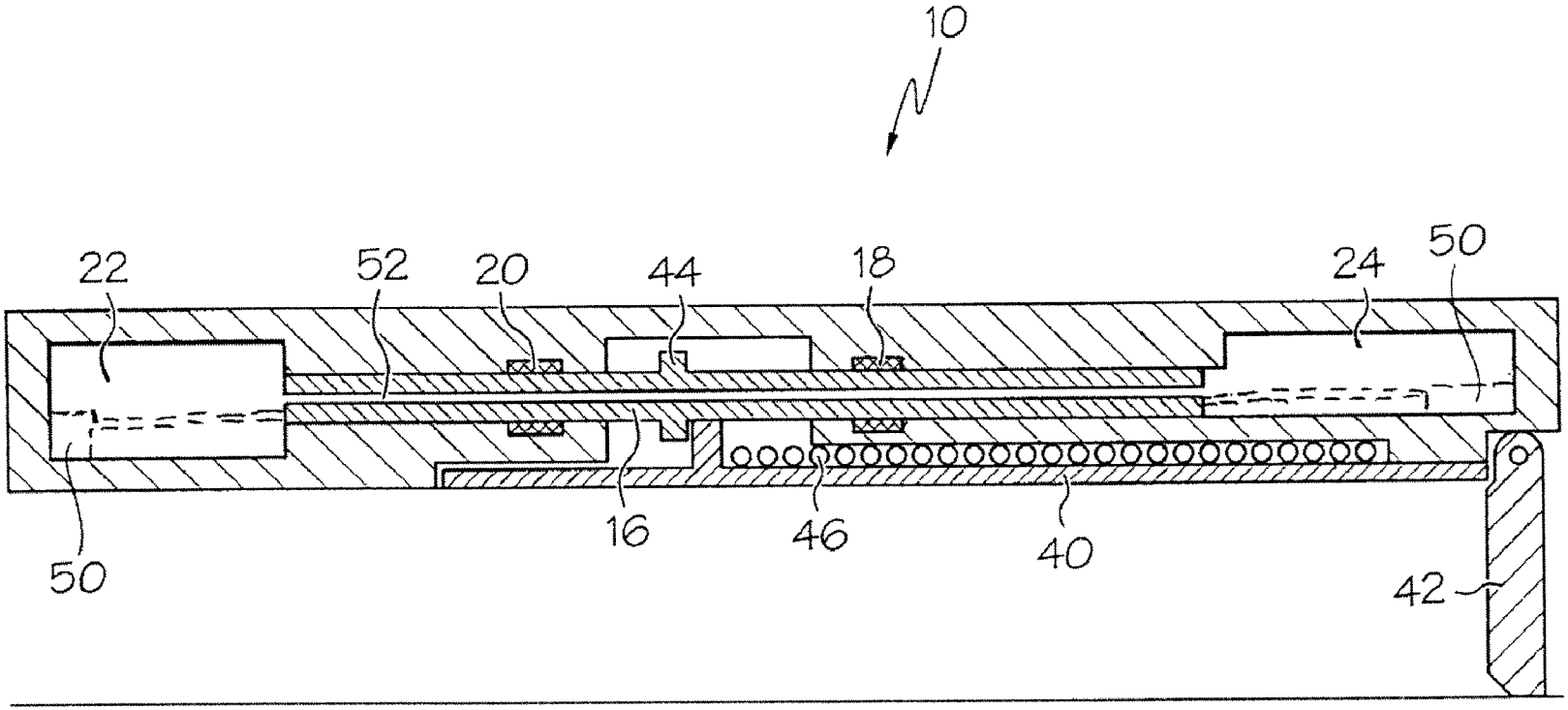
FIG. 3 is a schematic view of another alternate tubing pressure insensitive electrically actuated SCSSV and actuation configuration.

Referring to FIG. 3, another embodiment is illustrated. In this embodiment, seals 18 and 20 remain but force transmitter ring seal 30 has been eliminated. This is beneficial in that fewer seals equate to lower drag on the force transmitter 16 during movement thereof. Also, distinct in this embodiment is a channel 52 extending axially through the force transmitter 16 directly fluidly connecting the chamber 22 to the chamber 24. Due to the channel 52, pressure in chambers 22 and 24 is always equal. Tubing pressure is isolated by seals 18 and 20 as in previously addressed embodiments. In this embodiment, if either of the seals fails, tubing pressure is immediately transmitted to both ends of force transmitter 16 such that it still maintains a balance of pressure and is unaffected thereby. This embodiment will include one or more activators in either or both of the chambers 22 and 24, which may push or pull as required to bias the force transmitter against the power spring 46 and any differential pressure across the flapper 42. Additionally, it is to be noted that in the embodiment of FIG. 3, the fluid in chambers 22 and 24 need not be of a type that is volumetrically changeable without a significant change in pressure as is required in at least one of the chambers for each of FIGS. 1 and 2 but the embodiment of FIG. 3 also allows the use of incompressible fluids due to the ability of the system to move fluid from chamber to chamber. As in the previous embodiments, the activator is housed within the fluid and is thereby protected from potentially deleterious wellbore fluids. Further, it is noted that in the event that a hold open device is to be used in the valve 10, it can also be disposed within on or both of chambers 22 and 24 to protect the same from wellbore fluids. The fluid in the chambers including the activators could be, e.g., dielectric fluid.

With the embodiment of FIG. 3, it is also to be appreciated that a plurality of the illustrated systems could be used in conjunction with a single flow tube to have backup actuation capability. This is because, due to balancing, the actuator system that is not working does not create any significant load on the valve 10 but rather will act only as a shock absorber to some extent. Such plural systems may also be used together if required or desired for a particular application.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A tubing pressure insensitive actuator system comprising:

a housing having a bore therein;

a force transmitter sealingly moveable within the bore the force transmitter defining with the bore two fluid chambers the two fluid chambers being in fluid communication with each other, one at each longitudinal end of the force transmitter;

an activator in one or both of the two fluid chambers and operatively connected to the force transmitter, the activator being isolated from tubing pressure; and at least two seals sealingly positioned between the housing and the force transmitter, one of the seals isolating one end of the force transmitter from tubing pressure and another of the seals isolating another end of the force transmitter from tubing pressure, the housing, force transmitter and seals forming a closed fluid system.

2. The system as claimed in claim 1 wherein the housing is a housing of a subsurface safety valve.

3. The system as claimed in claim 1 wherein the housing further defines a plurality of chambers fluidly connected to the bore.

4. The system as claimed in claim 1 wherein the actuator system includes an activator.

5. The system as claimed in claim 1 wherein the force transmitter further includes a force transmitter ring seal.

6. The system as claimed in claim 5 wherein the one of the at least two seals and the force transmitter ring seal define, along with the force transmitter and the bore, an annulus, the annulus being fluidly communicated to an end of the force transmitter opposite an end of the force transmitter nearest the annulus.

7. The system as claimed in claim herein the force transmitter includes an interengagement for a flow tube.

8. The system as claimed in claim 1 wherein the force transmitter includes a channel axially extending from one force transmitter end to an opposite force transmitter end through the force transmitter thereby allowing fluid communication from a fluid chamber at one end of the force transmitter to a fluid chamber at the other end of the force transmitter.

9. The system as claimed in claim 1 wherein the housing further contains an activator disposed within a fluid isolated from wellbore fluid.

10. The system as claimed in claim 9 wherein the fluid is dielectric fluid.

11. The system as claimed in claim 10 wherein the dielectric fluid is air.

12. The system as claimed in claim 4 wherein the activator is in fluid communication with the force transmitter.

13. The system as claimed in claim 4 wherein the activator is in close proximity to the housing.

14. The system as claimed in claim 4 wherein the activator is attached to the housing.

15. The system as claimed in claim 4 wherein the activator is electric.

16. The system as claimed in claim 4 wherein the activator is electric-hydraulic.

17. The system as claimed in claim 4 wherein the activator is a motor and a lead screw.

18. The system as claimed in claim 4 wherein the activator is a solenoid.

19. The system as claimed in claim 4 wherein the activator is a pump and a fluid reservoir, fluid pressure engaged with one end of the force transmitter.

20. A tubing pressure insensitive actuator system for an electric surface controlled subsurface safety valve comprising:

a subsurface safety valve housing supporting a flow tube, a flapper and a power spring, the housing having a force transmitter bore therein;

a force transmitter sealingly moveable within the force transmitter bore, the force transmitter defining with the bore two fluid chambers, one at each longitudinal end of the force transmitter, at least one of the chambers containing an electric activator in operable communication with the force transmitter, the activator being isolated from tubing pressure;

an interengagement at the force transmitter force transmissively engaged with the flow tube, the interengagement exposed to tubing pressure during use; and at least two seals sealingly positioned between the housing and the force transmitter, one of the seals isolating one end of the force transmitter from tubing pressure and another of the seals isolating another end of the force transmitter from tubing pressure.

21. A method for reducing force requirements of an actuator in a downhole environment comprising:

sealing a force transmitter within a housing to isolate ends of the force transmitter from tubing pressure during use, respective ends being in communication with fluid chambers fluidly connected with each other; and initiating an activator to urge the force transmitter in a direction commensurate with activating a downhole tool, the activator isolated from tubing pressure and generating enough force to activate the downhole tool other than to overcome tubing pressure.

* * * * *